US008303070B2

(12) United States Patent
Kanda et al.

(10) Patent No.: US 8,303,070 B2
(45) Date of Patent: Nov. 6, 2012

(54) INK JET PRINTING APPARATUS AND INK JET PRINTING METHOD

(75) Inventors: Hidehiko Kanda, Yokohama (JP); Wakako Yamamoto, Sagamihara (JP); Yuji Hamasaki, Kawasaki (JP); Hirokazu Yoshikawa, Kawasaki (JP); Atsushi Sakamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 556 days.

(21) Appl. No.: 12/207,947

(22) Filed: Sep. 10, 2008

(65) Prior Publication Data

US 2009/0073202 A1 Mar. 19, 2009

(30) Foreign Application Priority Data

Sep. 14, 2007 (JP) ..... 2007-239324

(51) Int. Cl.
*B41J 2/205* (2006.01)
*B41J 2/15* (2006.01)

(52) U.S. Cl. ..... 347/15; 347/41

(58) Field of Classification Search ..... 347/15
See application file for complete search history.

(56) References Cited

U.S. PATENT DOCUMENTS

| | | | | |
|---|---|---|---|---|
| 6,030,065 | A * | 2/2000 | Fukuhata | 347/15 |
| 7,712,860 | B2 * | 5/2010 | Edamura et al. | 347/15 |
| 2005/0122377 | A1 * | 6/2005 | Mizutani et al. | 347/41 |
| 2007/0019031 | A1 * | 1/2007 | Murayama et al. | 347/15 |
| 2007/0285451 | A1 * | 12/2007 | Noguchi | 347/12 |
| 2011/0037799 | A1 * | 2/2011 | Nakano et al. | 347/12 |

FOREIGN PATENT DOCUMENTS

| | | | |
|---|---|---|---|
| JP | 60-107975 | A | 6/1985 |
| JP | 6-336015 | A | 12/1994 |

* cited by examiner

*Primary Examiner* — Shelby Fidler
(74) *Attorney, Agent, or Firm* — Fitzpatrick, Cella, Harper & Scinto

(57) ABSTRACT

When completing an image in a predetermined area by an odd or even number of bidirectional printing scans, this invention makes it possible to suppress lines of image defects and density variations and thereby print a high-quality image at high speed. In completing an image by an odd number of bidirectional printing scans, the print data for small ink droplets and large ink droplets are thinned using the first and second thinning pattern. The first and second thinning pattern thin the print data for small ink droplets and large ink droplets so that a difference between the total print ratio of all forward printing scans of the odd number of scans and the total print ratio of all backward printing scans of the odd number of scans when the first thinning pattern is used differs from that when the second thinning pattern is used.

12 Claims, 16 Drawing Sheets

| QUANTIZATION LEVEL | DOT PATTERN |
| --- | --- |
| 0 |   |
| 1 |   |
| 2 |   |

| | GRAYSCALE (QUANTIZATION LEVEL) | | | | | |
|---|---|---|---|---|---|---|
| | LOW (0 | | 1 | | | HIGH 2) |
| EMBODIMENT | ○ | ○ | ○ | ○ | ○ | ○ |
| COMPARISON EXAMPLE 1 | ○ | ○ | ○ | ○ | ○ | ○ |
| COMPARISON EXAMPLE 2 | ○ | △ | × | × | △ | △ |

FIG.8

| | GRAYSCALE (QUANTIZATION LEVEL) | | | | | |
|---|---|---|---|---|---|---|
| | LOW → HIGH (0 1 2) | | | | | |
| EMBODIMENT | ○ | ○ | ○ | ○ | ○ | ○ |
| COMPARISON EXAMPLE 1 | ○ | ○ | ○ | △ | × | × |
| COMPARISON EXAMPLE 2 | ○ | ○ | ○ | ○ | ○ | ○ |

FIG.9

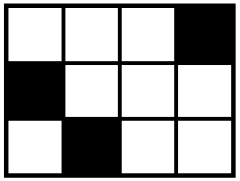
FIG.10A
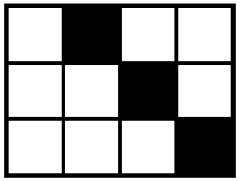
FIG.10B
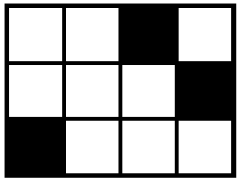
FIG.10C
FIG.10D

| | GRAYSCALE (QUANTIZATION LEVEL) | | | | | |
|---|---|---|---|---|---|---|
| | LOW → HIGH (0 1 2) | | | | | |
| EMBODIMENT | ○ | ○ | ○ | ○ | ○ | ○ |
| COMPARISON EXAMPLE 1 | ○ | ○ | ○ | △ | △ | × |
| COMPARISON EXAMPLE 2 | ○ | ○ | ○ | ○ | ○ | ○ |

FIG.12

INK JET PRINTING APPARATUS AND INK JET PRINTING METHOD

BACKGROUND OF THE INVENTION

1. Field of the Invention

The present invention relates to an ink jet printing apparatus and an ink jet printing method that complete an image in a predetermined print area on a print medium by performing a bidirectional printing scan of a print head capable of ejecting ink.

2. Description of the Related Art

Ink jet printing apparatus have been used widely as printing apparatus with functions of printer, copying machine and facsimile and as output devices for composite electronic devices such as computers and word processors and for workstations. These printing apparatus form an image (including letters) on a print medium such as paper and plastic sheets according to image information (letter information included). Since ink jet printing apparatus eject ink from a print head onto a print medium, a resolution of the printed image can be enhanced and a printing speed increased with greater ease than other types of printing apparatus. They also have an advantage of quiet operation and low cost. There are growing needs for color image printing and many ink jet printing apparatus that meet this demand have been developed.

For further improvement of the printing speed, such an ink jet printing apparatus uses a plurality of print heads each with an array of printing elements (also referred to as a multihead). Each of the printing elements includes an ink ejection opening and a corresponding ejection energy generation element. As the ejection energy generation element, a heater (heating resistive element) or a piezoelectric element may be used. In the following description, the ink ejection opening and the ejection energy generation element combine to form a "nozzle". In an ink jet printing apparatus that prints a color image, in general, a plurality of print heads each having such printing elements integrally arrayed are provided.

Japanese Patent Laid-Open No. 60-107975 discloses an ink jet printing apparatus of a so-called serial scan type as an example of the ink jet printing apparatus that uses a print head having a plurality of ink ejection openings formed in lines. The serial scan type ink jet printing apparatus forms an image on a print medium by ejecting ink from the nozzles of the print head as it moves the print head in a main scan direction and by alternating this main scan operation with a feeding operation that feeds the print medium in a sub-scan direction.

Japanese Patent Laid-Open No. 60-107975 also discloses a multi-path printing method that forms a high quality image without density variations by taking into account small variations in ink ejection characteristics among nozzles that occur in a print head manufacturing process and which affect an ink ejection volume and direction. The multi-path printing method completes an image in a predetermined print area with a plurality of print head scans and can print single lines in the main scan direction by using a plurality of nozzles. Using a plurality of nozzles in printing a predetermined unit print area, as described above, can minimize the effects of ejection characteristic variations among nozzles and form a high-quality image with no density variations. More specifically, Japanese Patent Laid-Open No. 60-107975 describes a 2-pass printing method that completes the printing operation on a 4-pixel-high print area with two scans. In the 2-pass printing, a first scan prints the 4-pixel-high band area in a hounds-tooth check pattern by using a thinning pattern; and a second scan prints the same band area in a reverse check pattern by using a reverse thinning pattern.

Japanese Patent Laid-Open No. 06-336015 also describes a construction that combines the multi-pass printing method with a bidirectional printing method that ejects ink as the print head moves both in a forward and a backward direction. More specifically, in a 3-pass bidirectional printing method, print ratios during a first, second and third scan are set at 25%, 50% and 25%.

For the ink jet printing apparatus to print a high-quality image at high speed, small ink droplets need to be ejected from a print head at high frequency. In that case, however, there is a possibility of a stripe of print variations being formed in printed images I(n) and I(n+1), as shown in FIG. 13.

FIG. 13 is an explanatory diagram showing an operation of a single-pass printing that completes printing on a predetermined print area with one scan of the print head H. An image printed based on print data D(n) during the n-th scan of the print head H is shown at I(n), which has blank lines formed at the upper and lower parts thereof where no ink droplets land. An image printed based on print data D(n+1) during the (n+1)st scan of the print head H is shown at I (n+1), which also has blank lines formed at the upper and lower parts thereof. Such lines of image defects often occur in areas with high ink dot densities (high print duties).

FIG. 14 is a diagram explaining a possible cause for such lines of image defects that occur during image printing, with ink droplets shown being ejected from the print head H toward a print medium P. This diagram represents a solid printing, a printing operation with a dot density (print duty) of 100% in which all nozzles (e.g., 256 nozzles) in the print head H are activated to eject ink. In this printing state, ink droplets ejected from those nozzles situated near the ends of the nozzle array (nozzles near the upper and lower ends in FIG. 14) are deflected toward the center of the nozzle array as they fly toward the print medium P. The reason for this phenomenon is as follows. Since all the nozzles are activated at high frequency to eject ink, air immediately surrounding the ejected ink droplets also move in the same direction as the ink droplets. That is, as the air immediately surrounding the droplets moves, the surrounding air is negatively pressurized, causing outside air of the surrounding air to move toward the decompressed space, thus generating an air flow directed toward the center of the nozzle array, as indicated by an arrow in FIG. 14. This air flow causes the ink droplets ejected from the nozzles near the ends of the nozzle array to deflect inwardly to the center of the nozzle array (this phenomenon is also referred to as an "end nozzle droplet deflection"). As a result of this end nozzle droplet deflection, ink droplets ejected from those nozzles situated near the ends of the nozzle array land at positions, i.e., dot forming positions, deviated from intended ones, leading to a possibility of lines of image defects being formed as shown in FIG. 13.

To avoid such an end nozzle droplet deflection phenomenon, a method may be conceived that increases the volume of ink droplets to make them unlikely to be easily affected by the air flow. Making the ink droplets large, however, contributes to showing more distinctively the granularity of the dots formed on a print medium, degrading the quality of printed image. Further, lowering the ink ejection frequency or reducing the number of nozzles provided in the print head or lowering the nozzle arrangement density to minimize the end nozzle droplet deflection phenomenon can lead to a reduction in the printing speed.

The end nozzle droplet deflection phenomenon depends on the density (print duty) of dots formed in one scan of the print head. So, the similar phenomenon can occur when the density (print duty) of dots is high not only during the single-pass printing operation, such as shown in FIG. 13, but also during a multi-pass printing operation, such as described in Japanese Patent Laid-Open No. 60-107975.

FIGS. 15A to 15C show a relation between the scan directions of the print head in the bidirectional printing method and dots formed of ink droplets that have landed on a print medium.

In a bidirectional printing operation, the print head H ejects ink from its nozzles N as it moves in both the forward direction of arrow X1 and the backward direction of arrow X2 in FIG. 15A. FIG. 15B shows landing positions of ink droplets when the print head H scans in the forward direction. FIG. 15C illustrates landing positions of ink droplets when the print head H scans in the backward direction. D1 represents a main ink droplet ejected from the nozzles N and D2 represents a sub ink droplet ejected from the nozzles N following the main droplet D1. The print head in FIG. 15A has the direction of ink ejection from the nozzles N slightly inclined toward the forward direction (arrow X1). So, during the forward scan the sub droplet D2 lands at the same position as the main droplet D1, as shown in FIG. 15B. During the backward scan, however, the sub droplet D2 lands at a position deviated from the main droplet D1 in the backward direction (direction of arrow X2), as shown in FIG. 15C.

In a multi-pass printing operation that completes an image in a predetermined print area with an odd number of scans, a first region and a second region, described below, are alternated in position on a print medium. The first region is an area in which an image printing is completed by an even number of forward scans and an odd number, which is one less than the even number, of backward scans, i.e., the area that is completed with a higher ratio of dots printed by forward scans than that of backward scans and in which the printing starts and ends with a forward scan. The second region is an area in which an image printing is completed by an even number of backward scans and an odd number, which is one less than the even number, of forward scans, i.e., the area that is completed with a higher ratio of dots printed by backward scans than that of forward scans and in which the printing starts and ends with a backward scan. Since the first and the second region are alternated in position, density variations can occur in the printed image.

A main cause for the density variations is the fact that the second region with a higher ratio of dots printed by backward scans as shown in FIG. 15C has a wider ink landing area in unit area than that of the first region with a higher ratio of dots printed by forward scans as shown in FIG. 15B. A difference in ink landing area between the two regions can lead to density variations.

In a multi-pass printing that completes the printing operation in a predetermined print area with an odd number of scans, when an image is printed using a plurality of colors of ink droplets, the alternate formation of the first and the second region can result in color variations in a printed image.

Suppose, for example, a blue color is expressed by overlapping a magenta (M) ink and a cyan (C) ink using a print head with nozzle arrays formed to eject yellow (Y), magenta (M), cyan (C) and black (K) inks. In this case, in forward scans the cyan (C) ink lands first, followed by the magenta ink. In backward scans the magenta (M) ink lands first, followed by the cyan (C) ink. This difference in the ink droplet landing order can produce a color difference to a degree that is visible on a printed image. The reason for this is that the ink that has landed first tends to be dominant in color over a subsequently landing ink. The alternate formation of the first and the second region can cause color differences between these regions, which in turn result in color variations.

As described above, Japanese Patent Laid-Open No. 06-336015 describes a 3-pass bidirectional printing method in which 1st, 2nd and 3rd scan is set at print ratios of 25%, 50% and 25% respectively. In this configuration, when we look at a unit print area printed by a total of three scans, it is possible to make a print ratio for all forward scans and a print ratio for all backward scans equal at 50%. This can reduce density variations. It should be noted, however, that since the second scan has a high print ratio of 50%, the density (print duty) of dots formed by the second scan becomes high, which in turn may cause the end nozzle droplet deflection phenomenon of FIG. 14, resulting in lines of image defects.

The density (print duty) of dots formed in one scan can be reduced by lowering the ink ejection frequency or increasing the number of scans required to complete the image printing in a predetermined print area, in order to suppress the end nozzle droplet deflection phenomenon. This, however, can cause a reduction in the printing speed.

SUMMARY OF THE INVENTION

The present invention provides an ink jet printing apparatus and method that scans a print head, which ejects large and small ink droplets of different volumes, in forward and backward directions an odd number of times in total to complete an image in a predetermined print area of a print medium and suppresses both lines of image defects and density variations, assuring high quality images and high-speed printing.

In the first aspect of the present invention, there is provided an ink jet printing apparatus to print an image by scanning a print head capable of ejecting large and small ink droplets of different volumes over a predetermined area of a print medium a plurality of times, the ink jet printing apparatus comprising: control unit that causes the print head to scan over the predetermined area in a forward direction and a backward direction an odd number of times in total; wherein the control unit causes the print head to eject the ink droplets based on print data for ejecting the small ink droplets and on print data for ejecting the large ink droplets, the print data for ejecting the small ink droplets being thinned by a first thinning pattern so as to divide one complete scan into the odd number of scans, the print data for ejecting the large ink droplets being thinned by a second thinning pattern so as to divide one complete scan into the odd number of scans; wherein the first thinning pattern and the second thinning pattern are thinning patterns that differ from each other in a difference between a total print ratio of all the forward scans of the odd number of scans and a total print ratio of all the backward scans of the odd number of scans.

In the second aspect of the present invention, there is provided an ink jet printing method to print an image by scanning a print head capable of ejecting large and small ink droplets of different volumes over a predetermined area of a print medium in a forward direction and a backward direction an odd number of times in total, the method comprising: a first thinning step to thin print data for ejecting the small ink droplets by using a first thinning pattern so as to divide one complete scan into the odd number of scans; a second thinning step to thin print data for ejecting the large ink droplets by using a second thinning pattern so as to divide one complete scan into the odd number of scans; and a step to print an image by causing the print head to eject the ink droplets based on the print data thinned by the first and second thinning step; wherein the first thinning pattern and the second thinning pattern are thinning patterns that differ from each other in a difference between a total print ratio of all the forward scans of the odd number of scans and a total print ratio of all the backward scans of the odd number of scans.

With this invention, where an image is to be completed by an odd number of bidirectional printing scans (first print mode), a first and a second thinning pattern are used as patterns to thin print data for ejecting small and large ink droplets. Where an image is to be completed by an even number of bidirectional printing scans (second print mode), a third and a fourth thinning pattern are used as patterns to thin print data for ejecting small and large ink droplets.

The first and second thinning patterns are configured to thin print data for small ink droplets and large ink droplets in a way that differentiates two differences—a first difference in a total print ratio between all forward scans and all backward scans of an odd number of scans when the first thinning patterns are used and a second difference in a total print ratio between all forward scans and all backward scans of an odd number of scans when the second thinning patterns are used. The third and fourth thinning patterns are configured to thin print data for small ink droplets and large ink droplets in a way that makes two differences equal—a third difference in a total print ratio between all forward scans and all backward scans of an even number of scans when the third thinning patterns are used and a fourth difference in a total print ratio between all forward scans and all backward scans of an even number of scans when the fourth thinning patterns are used.

As a result, where an image in a predetermined print area is to be completed by an odd number of bidirectional printing scans, both the lines of image defects and density variations can be suppressed, assuring the printing of high-quality images at high speed. Likewise, where an image is to be completed by an even number of bidirectional printing scans, a high-quality image can be printed at high speed.

Further features of the present invention will become apparent from the following description of exemplary embodiments (with reference to the attached drawings).

BRIEF DESCRIPTION OF THE DRAWINGS

FIG. 8 is a table showing a result of subjective evaluation on a degree of seriousness of linear image defects in the first embodiment of this invention;

FIG. 9 is a table showing a result of subjective evaluation on a degree of seriousness of density variations in the first embodiment of this invention;

FIGS. 10A, 10B, 10C and 10D are explanatory diagrams showing thinning patterns to thin print data during a second print mode in the first embodiment of this invention;

FIG. 12 is a table showing a result of subjective evaluation on a degree of seriousness of color variations in a second embodiment of this invention;

DESCRIPTION OF THE EMBODIMENTS

Now, embodiments of this invention will be described by referring to the accompanying drawings.

(First Embodiment)

Figure 1:
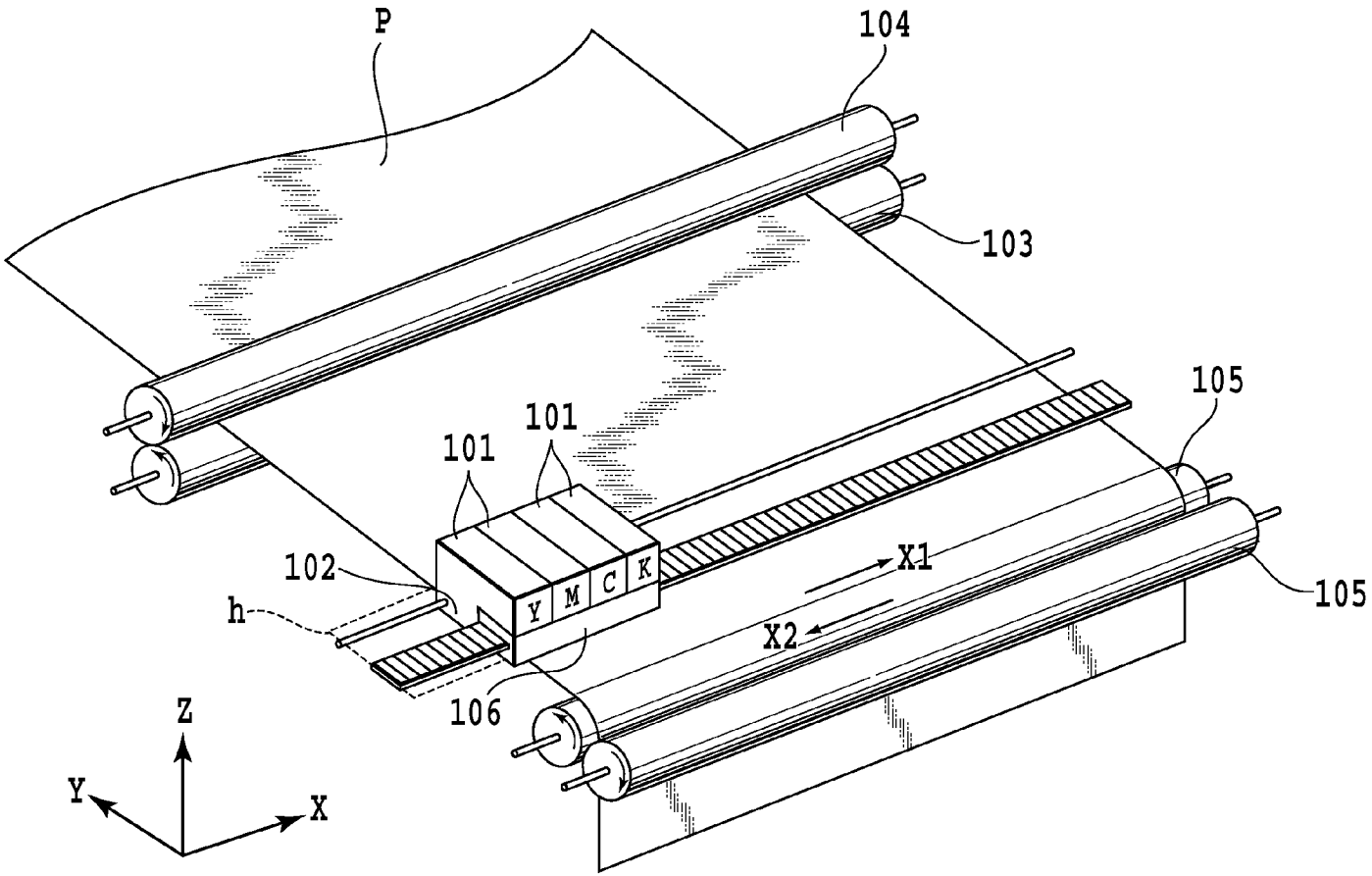
FIG. 1 is a schematic perspective view of an ink jet printing apparatus of a first embodiment of this invention.

FIG. 1 is a perspective view showing an essential part of an ink jet printing apparatus applicable to this invention. Reference number 101 represents four ink cartridges, each composed of an ink tank and a print head (multi-head) 102 having a plurality of arrays of printing elements integrally formed therein. These ink tanks accommodate black (K), cyan (C), magenta (M) and yellow (Y) inks. The print head 102 may be formed separated from the ink tank. Each of the printing elements in the print head 102 includes an ink ejection opening and a corresponding ejection energy generation element. As the ejection energy generation element a heater (heating resistive element) and a piezoelectric element may be used. In the following description, a portion including such an ink ejection opening and an ejection energy generation element is called a "nozzle".

Denoted 103 is a paper feed roller which, together with an auxiliary roller 104, keeps a sheet of paper (print medium) P stretched as it rotates in a direction of arrow to intermittently feed the print medium P in a sub-scan direction indicated by arrow Y. Designated 105 is a paper supply roller which supplies the print medium P and, like the rollers 103, 104, has a function of holding the print medium P in a stretched state. Designated 106 is a carriage that can mount the four ink cartridges 101 and reciprocally moves along an arrow X in the main scan direction. A direction of +X is referred to as a forward direction X1 and a direction of −X as a backward direction X. The main scan direction and the sub-scan direction cross each other, in this example, at right angles. The carriage 106, when not performing a printing operation or when performing a print head recovery operation, moves to a home position (h) indicated by a dashed line and stands by.

Figure 2:
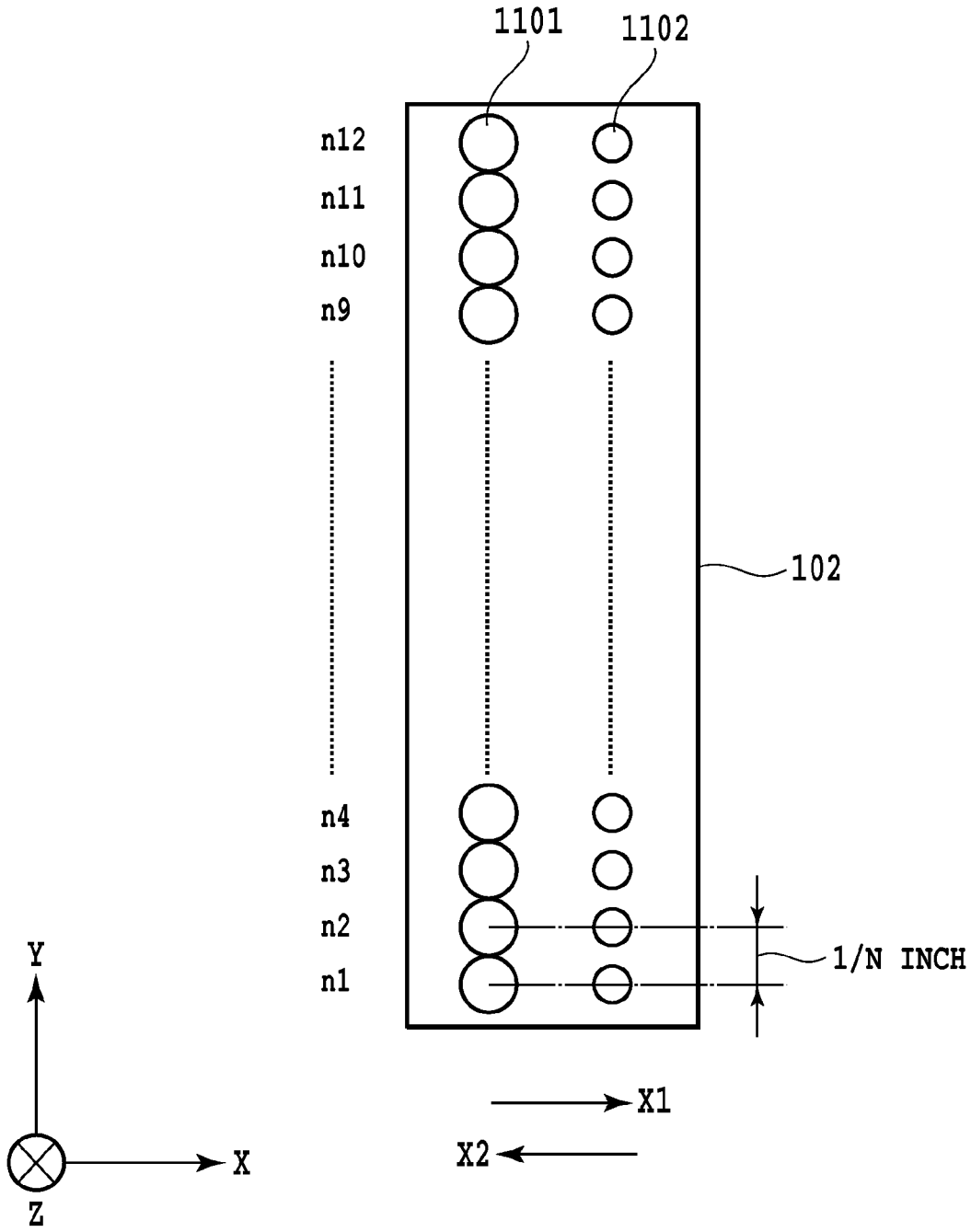
FIG. 2 is an explanatory diagram showing nozzles of a print head in the ink jet printing apparatus of FIG. 1.

FIG. 2 shows nozzle arrays formed in the print head 102 for ejecting cyan ink, as seen from a direction Z. The print head 102 is formed with ejection openings 1101, 1102 as cyan ink ejection openings. The ejection openings 1101 are large ink ejection openings to eject ink droplets of a large volume (first volume) and ejection openings 1102 are small ink ejection openings to eject ink droplets of a small volume (second volume, smaller than the first volume)

Like these cyan ink ejection openings, ejection openings to eject other color inks may also be constructed to eject large and small volumes of ink. In this embodiment, only the cyan ink ejection openings include large ink ejection openings and small ink ejection openings. The following explanation mainly centers on a construction and control for ejecting a cyan ink from these large ink ejection openings and small ink ejection openings.

There are n ejection openings each for 1101 and 1102 to provide a print image density of N dots per inch. In FIG. 2, 12 ejection openings each for 1101 and 1102 are provided to correspond to a print image density of 600 dots per inch (600 dpi). Ink droplets ejected from the large ink ejection openings 1101 ("large ink droplets") are 10 pl and those ejected from the small ink ejection openings 1102 ("small ink droplets") are 5 pl. For stable ejection of these ink droplets, an ejection frequency is set at 30 kHz and an ejection speed at about 18 m/sec. A travel speed in the main scan direction of the carriage 106 mounting the print head 102 is set at 25 inches/sec. These settings produce an image print density in the main scan direction of 1,200 dpi.

Figure 15C:
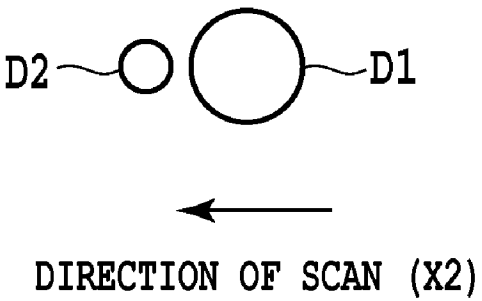
FIG. 15C illustrates ink droplet landing areas during a backward scan of the print head of FIG. 15A.
Figure 15B:
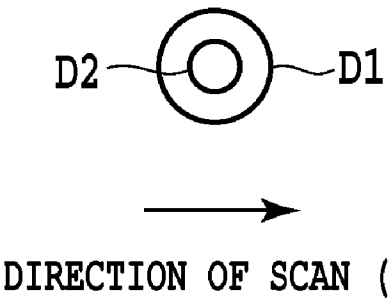
FIG. 15B illustrates ink droplet landing areas during a forward scan of the print head of FIG. 15A.
Figure 15A:
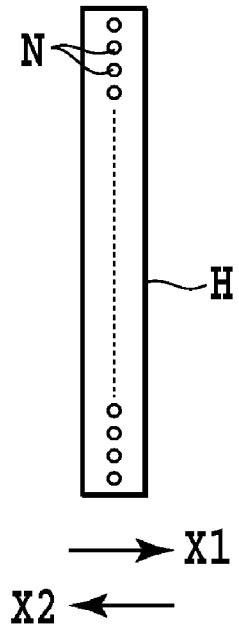
FIG. 15A schematically shows an outline construction of a conventional print head.
Figure 16:
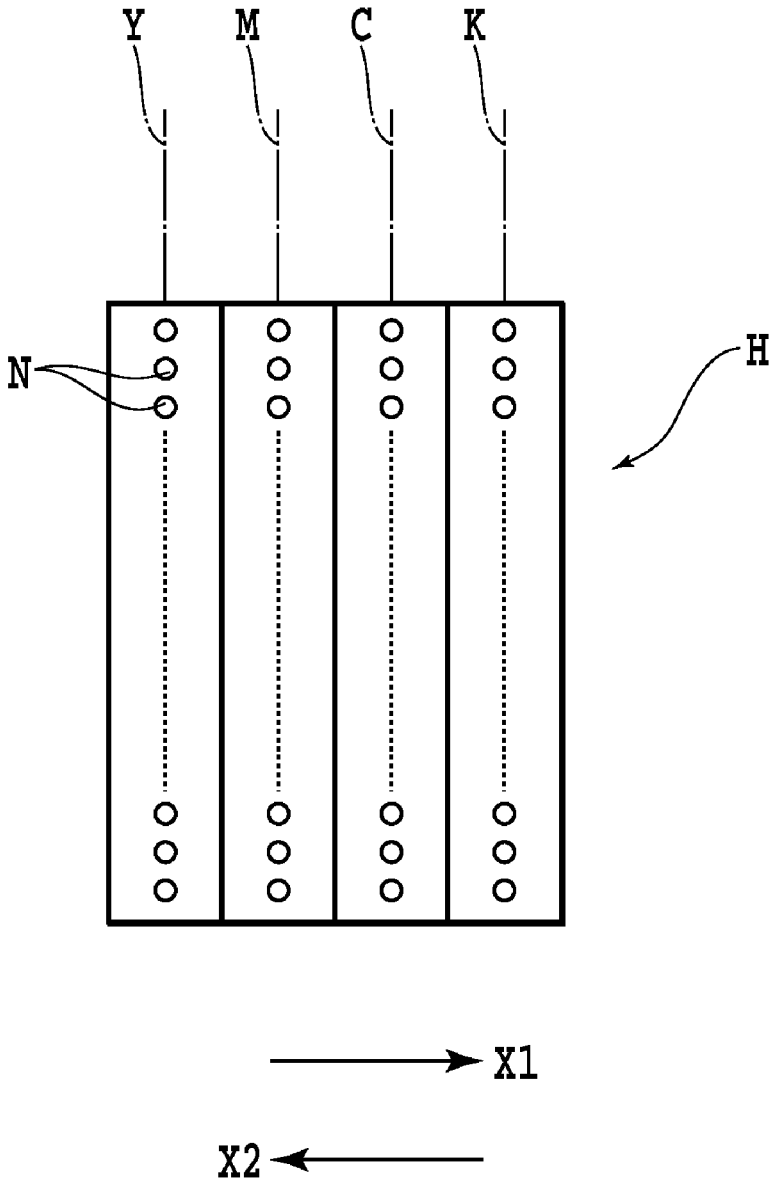
FIG. 16 schematically shows an outline construction of another conventional print head.

Ink ejection directions of both ejection openings 1101 and 1102 are slightly tilted toward the forward direction (direction of arrow X1) and thus a main droplet and a sub droplet ejected from these openings land as shown in FIG. 15B and FIG. 15C. That is, during the forward scan, the sub droplet D2 lands at the same position as the main droplet D1. During the backward scan, however, the sub droplet D2 lands at a position deviated from the main droplet D1 in the backward direction (direction of arrow X2).

Figure 3:
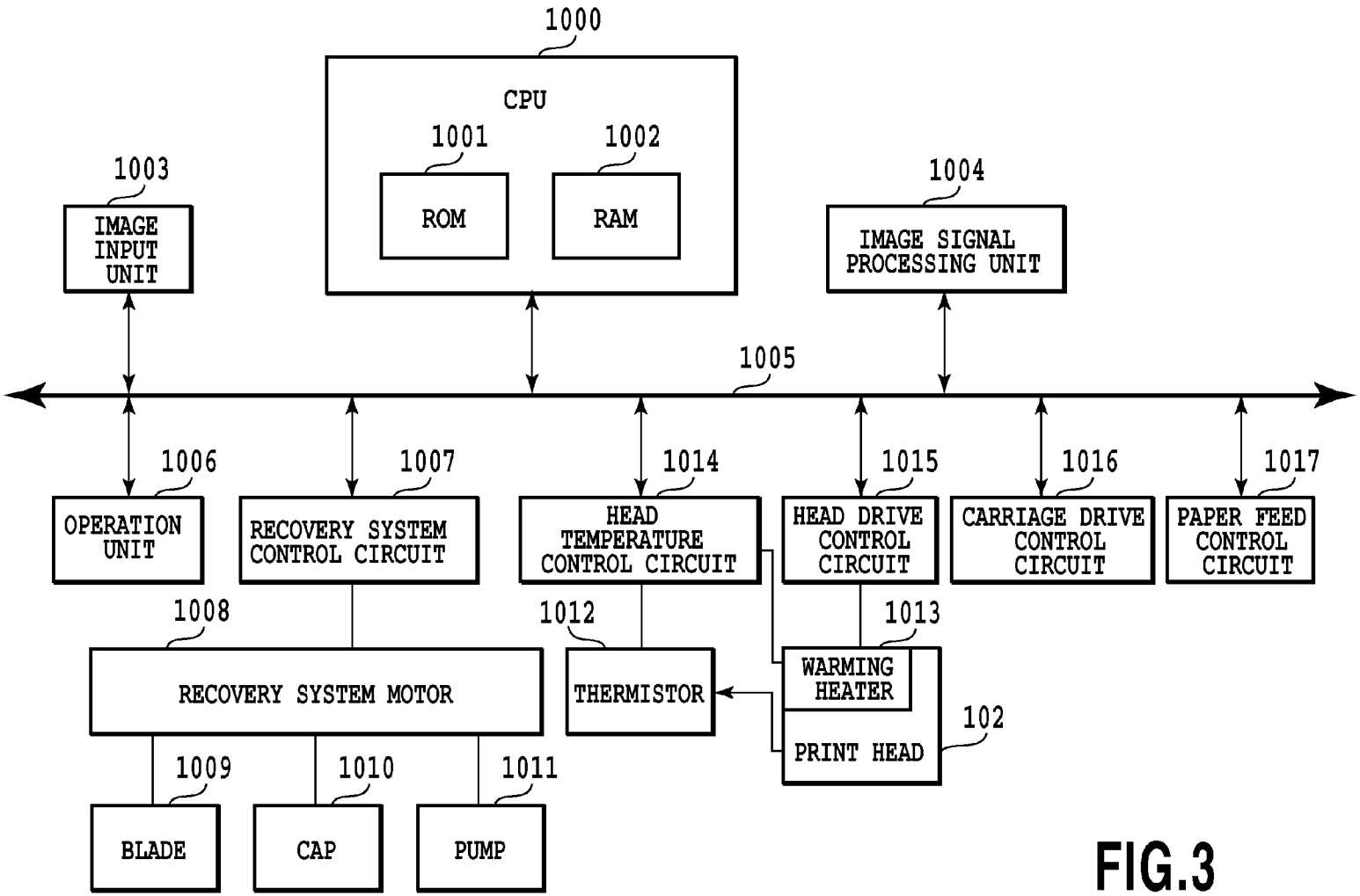
FIG. 3 is a block configuration diagram of a control system in the ink jet printing apparatus of FIG. 1.

FIG. 3 is a block configuration diagram of a control system in the ink jet printing apparatus.

The control system of this example is largely divided into software system processing means and hardware system processing means. The software system processing means includes an image input unit 1003, an image signal processing unit 1004 and a central processing unit CPU 1000, all accessing a main busline 1005. The hardware system processing means includes an operation unit 1006, a recovery system control circuit 1007, an ink jet head temperature control circuit 1014, a head drive control circuit 1015, a carriage drive control circuit 1016 and a paper feed control circuit 1017. The carriage drive control circuit 1016 controls the operation of the carriage 106 in the main scan direction, and the paper feed control circuit 1017 controls the transport of print medium P in the sub-scan direction.

The CPU 1000 has a ROM 1001 and a random memory (RAM) 1002 and, based on proper print conditions corresponding to input information, drives the print head 1013. In the RAM 1002, a program is stored for executing a print head recovery operation. By executing the program as required, conditions to eject ink not contributing to the printing of an image (preliminary ejection) are given to the recovery system control circuit 1007, the print head 102, a head warming heater 1013 and others. A recovery system motor 1008 drives a cleaning blade 1009, a cap 1010 and a suction pump 1011. The cleaning blade 1009 cleans an ejection opening formation surface of the print head 102. The cap 1010 caps the ejection opening formation surface, and the suction pump 1011 sucks out from the cap 1010 the waste ink that has been discharged from the print head into the cap 1010. The head drive control circuit 1015 drives an ejection energy generation means (in this case, electrothermal transducing elements or heaters) in the print head 102 to eject ink from the print head 102 to execute the printing operation and the preliminary ejection.

The warming heater 1013 is installed in the same board of the print head 102 in which the electrothermal transducing elements are provided, and is adapted to adjust the ink temperature in the print head 102 to a desired set temperature. A thermistor 1012 is installed in the board of the print head 102 to measure practically the ink temperature in the print head. The warming heater 1013 and the thermistor 1012 may be provided in the vicinity of the print head 102 or outside it.

Figure 4:
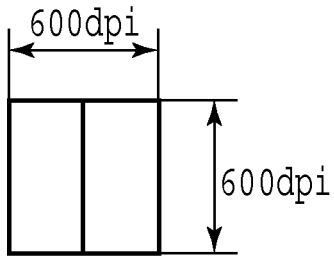
FIG. 4 is an explanatory diagram showing a relation between quantization levels of print data and dot patterns.
Figure 4:
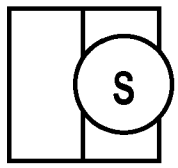
Figure 4:
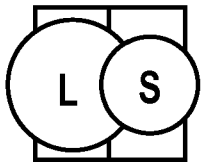

FIG. 4 shows a relation between a quantization level (grayscale level) of image data and a dot pattern formed by the print head 102 of FIG. 2. L denotes a large dot formed by a large ink droplet ejected from the large ink ejection opening 1101. S denotes a small dot formed by a small ink droplet ejected from the small ink ejection opening 1102.

In this example, a unit pixel with a resolution of 600 dpi× 600 dpi expresses one of three grayscale levels represented by a quantization level 0-2. That is, each pixel is set with a 2×1-matrix area, in which two kinds of ink droplets of different volumes are landed to form a large dot L and a small dot S. With this arrangement, the three grayscale levels represented by quantization levels 0-2 can be expressed by three different dot patterns, including no-dot pattern (quantization level 0) in which no dots are formed in the pixel area.

Quantization level 0 corresponds to a no-dot pattern in which no dots are formed at all in the pixel area. Quantization level 1 corresponds to a pattern in which a small ink droplet of 5 pl is applied to one of the divided areas in the pixel to form one small dot S. Quantization level 2 corresponds to a pattern that has a combination of a small dot S formed by a 5-pl droplet and a large dot L formed by a 10-pl droplet. The ink volume applied to each of 600×600-dpi pixels is 0 pl at quantization level 0, 5 pl at quantization level 1 and 15 pl at quantization level 2.

(First Print Mode)

Figure 5C:
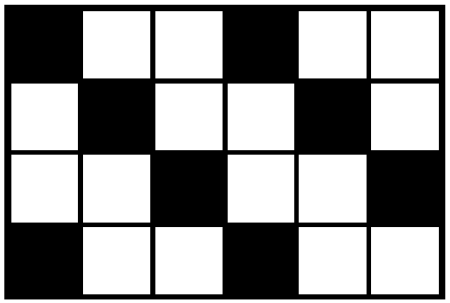
FIGS. 5A, 5B and 5C are explanatory diagrams showing patterns to thin print data for small-volume ink droplets in the first embodiment of this invention.
Figure 5B:
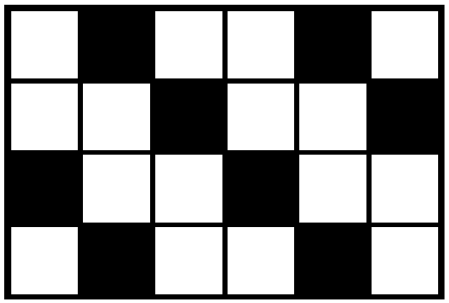
Figure 5A:
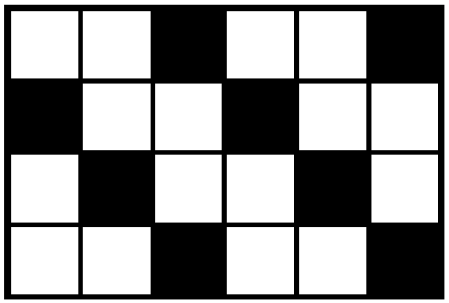
Figure 6C:
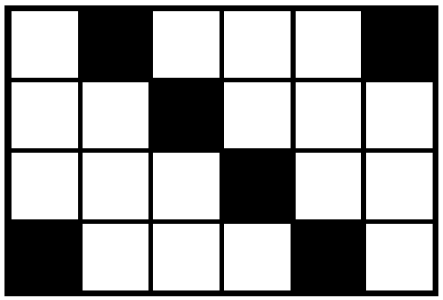
FIGS. 6A, 6B and 6C are explanatory diagrams showing patterns to thin print data for large-volume ink droplets in the first embodiment of this invention.
Figure 6B:
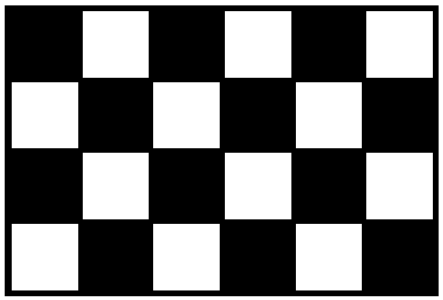
Figure 6A:
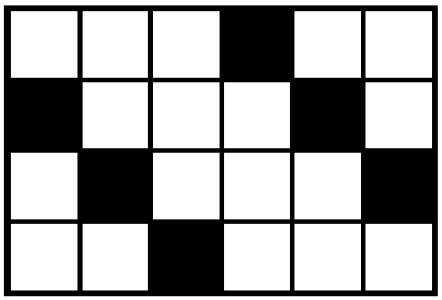

FIGS. 5A-5C and FIGS. 6A-6C show patterns used to thin print data in a print mode that completes a printing operation in a predetermine print area (first print region) by an odd number of bidirectional printing scans (hereinafter referred to as a "first print mode"). In the first print mode of this example, the printing operation in a predetermined print area is completed by three bidirectional printing scans. Patterns shown in FIGS. 5A-5C are used to thin print data for forming small dots S, and those shown in FIGS. 6A-6C are used to thin print data for forming large dots L.

FIGS. 5A, 5B and 5C show patterns to thin print data to be printed in a first, second and third scan, respectively (hereinafter referred to also as a "small dot thinning pattern" or "first thinning pattern"). This small dot thinning patterns (first thinning patterns for small dots) thin print data in such a way that the dot densities (print duties) in each scan will be one-third of the 100% print data. That is, the small dot thinning patterns are complementary to one another, with the print ratio (small dot forming ratio) in the first, second and third scan being one-third of the 100% print data.

FIGS. 6A, 6B and 6C show patterns to thin print data to be printed in a first, second and third scan, respectively (hereinafter referred to also as a "large dot thinning pattern" or "second thinning pattern"). This large dot thinning patterns (first thinning patterns for large dots) thin print data in such a way that the dot densities (print duties) in the first, second and third scan will be ¼, ½, and ¼ of the 100% print data, respectively. That is, the large dot thinning patterns are complementary to one another, with the print ratio (large dot forming ratio) in the first, second and third scan being ¼, ½ and ¼.

Figure 7:
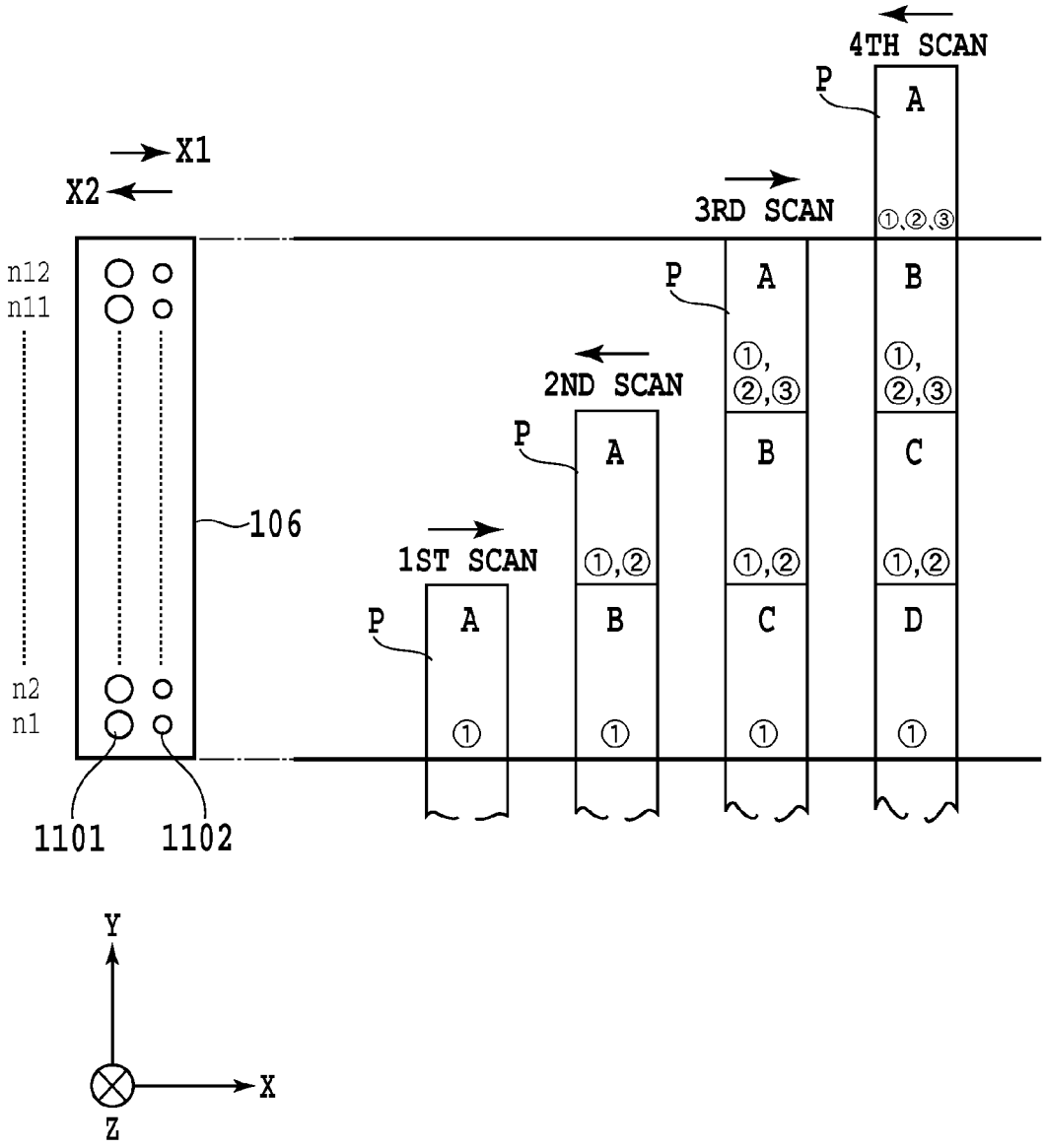
FIG. 7 is an explanatory diagram showing a first print mode-based printing method in the first embodiment of this invention.

FIG. 7 explains a printing operation during the first print mode.

First, the print medium P is fed in the sub-scan direction (Y direction) to allow four large ink ejection openings 1101 of nozzle number n1 to n4 upstream with respect to the paper feed direction and four small ink ejection openings 1102 of the same nozzle number n1 to n4 to print on the print medium P. After the print medium P has been fed, a print region A of the print medium P is printed in the first scan in the forward direction (X1 direction) using the n1-n4 large ink ejection openings 1101 and n1-n4 small ink ejection openings 1102. At this time, the n1-n4 small ink ejection openings 1102 eject small ink droplets of 5 pl based on the print data thinned by the thinning pattern of FIG. 5A. At the same time, the n1-n4 large ink ejection openings 1101 eject large ink droplets of 10 pl based on the print data thinned by the thinning pattern of FIG. 6A.

Then, the print medium P is fed in the sub-scan direction (Y direction) so that eight large ink ejection openings 1101 of nozzle number n1-n8 and eight small ink ejection openings 1102 of the same nozzle number n1-n8 can print on the print medium P. The feed distance corresponds to four dots of a 600-dpi resolution. After the feed operation is completed, print regions A, B of the print medium P are printed in the second scan in the backward direction (X2 direction).

The print region A is printed using n5-n8 large ink ejection openings 1101 and n5-n8 small ink ejection openings 1102. At this time, the n5-n8 small ink ejection openings 1102 eject small ink droplets of 5 pl based on the print data thinned by the thinning pattern of FIG. 5B. At the same time, the n5-n8 large ink ejection openings 1101 eject large ink droplets of 10 pl based on the print data thinned by the thinning pattern of FIG. 6B.

The print region B is printed using n1-n4 large ink ejection openings 1101 and n1-n4 small ink ejection openings 1102. At this time, the n1-n4 small ink ejection openings 1102 eject small ink droplets of 5 pl based on the print data thinned by the thinning pattern of FIG. 5A. At the same time, the n1-n4 large ink ejection openings 1101 eject large ink droplets of 10 pl based on the print data thinned by the thinning pattern of FIG. 6A. Thus, for the print region B this scan is the first one.

Then, the print medium P is fed in the sub-scan direction (Y direction) so that large ink ejection openings 1101 of nozzle number n1-n12 and small ink ejection openings 1102 of the same nozzle number n1-n12 can print on the print medium. The feed distance corresponds to four dots of a 600-dpi resolution. After the feed operation is completed, print regions A, B, C of the print medium P are printed in the third scan in the forward direction (X1 direction).

The print region A is printed using n9-n12 large ink ejection openings 1101 and n9-n12 small ink ejection openings 1102. At this time, the n9-n12 small ink ejection openings 1102 eject small ink droplets of 5 pl based on the print data thinned by the thinning pattern of FIG. 5C. At the same time, the n9-n12 large ink ejection openings 1101 eject large ink droplets of 10 pl based on the print data thinned by the thinning pattern of FIG. 6C. The third scan completes the image printing in the print region A.

The print region B is printed using n5-n8 large ink ejection openings 1101 and n5-n8 small ink ejection openings 1102. At this time, the n5-n8 small ink ejection openings 1102 eject small ink droplets of 5 pl based on the print data thinned by the thinning pattern of FIG. 5B. At the same time, the n5-n8 large ink ejection openings 1101 eject large ink droplets of 10 pl based on the print data thinned by the thinning pattern of FIG. 6B. Thus, for the print region B this scan is the second one.

The print region C is printed using n1-n4 large ink ejection openings 1101 and n1-n4 small ink ejection openings 1102. At this time, the n1-n4 small ink ejection openings 1102 eject small ink droplets of 5 pl based on the print data thinned by the thinning pattern of FIG. 5A. At the same time, the n1-n4 large ink ejection openings 1101 eject large ink droplets of 10 pl based on the print data thinned by the thinning pattern of FIG. 6A. Thus, for the print region C this scan is the first one.

Then, the print medium P feed operation and the printing scan are alternately repeated in the similar way to successively form bands of image until a complete image is formed on a print medium P.

FIGS. 8 and 9 show results of observations of images printed by the first print mode of this embodiment. FIG. 8 represents a result of evaluation on a degree of seriousness of lines of image defects in a printed image. FIG. 9 represents a result of evaluation on a degree of seriousness of density variations in a printed image. In the evaluation result for this embodiment and comparison examples 1, 2, a mark x represents "bad" as a subjective evaluation of image quality in terms of lines of image defects and density variations, Δ represents "slightly bad" and o represents "no problem". The results of these evaluations show that this embodiment has no problem.

The comparison example 1 used thinning patterns of FIG. 5A, FIG. 5B and FIG. 5C instead of those of FIG. 6A, FIG. 6B and FIG. 6C used in this embodiment, as the thinning pattern to thin print data for large ink ejection openings 1101. That is, to thin print data for both the large ink ejection openings 1101 and the small ink ejection openings 1102, the thinning patterns of FIG. 5A, FIG. 5B and FIG. 5C are used.

The comparison example 2, on the other hand, used thinning patterns of FIG. 6A, FIG. 6B and FIG. 6C instead of those of FIG. 5A, FIG. 5B and FIG. 5C used in this embodiment, as the thinning pattern to thin print data for small ink ejection openings 1101. That is, to thin print data for both the large ink ejection openings 1101 and the small ink ejection openings 1102, the thinning patterns of FIG. 6A, FIG. 6B and FIG. 6C are used.

Figure 13:
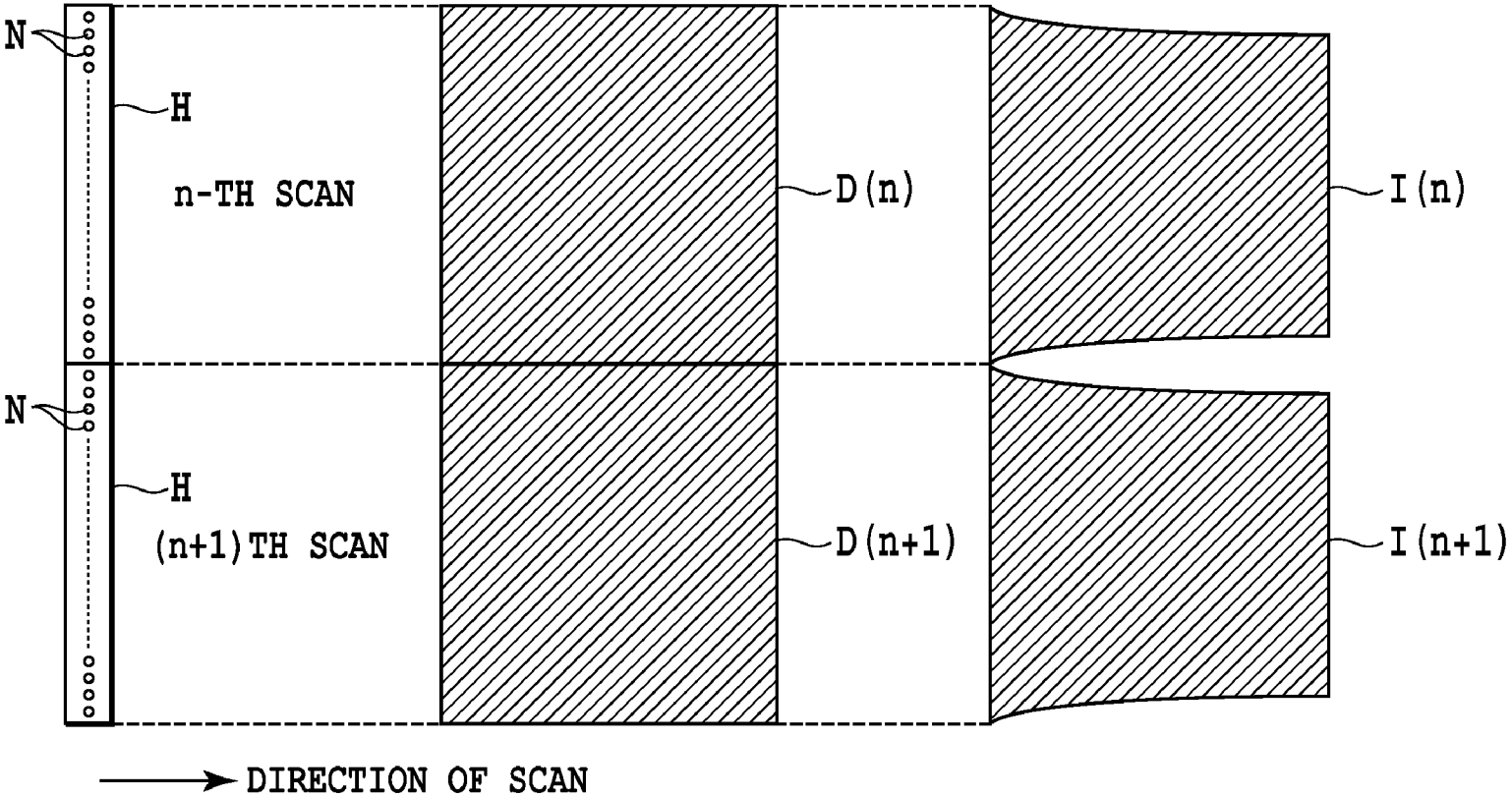
FIG. 13 is an explanatory diagram showing lines of image defects caused by an end nozzle droplet deflection phenomenon.
Figure 14:
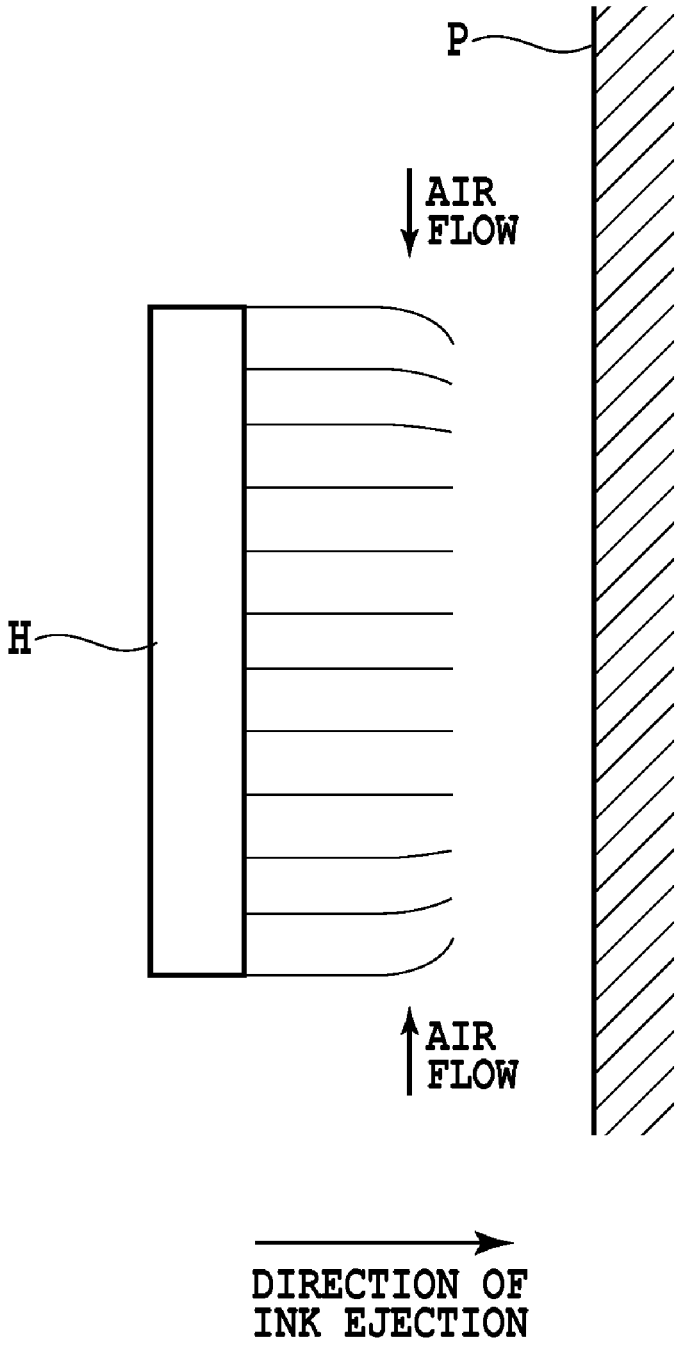
FIG. 14 is an explanatory diagram showing the end nozzle droplet deflection phenomenon.

It is found from the evaluation result of FIG. 8 that neither of this embodiment nor the comparison example 1 has produced lines of image defect. In comparison example 2, however, lines of image defects occurred in a gradation range whose quantization level is close to 1, i.e., where the image duty for the small ink droplets of 5 pl is close to 100%. In the case of the comparison example 2, the thinning patterns of FIG. 6A, FIG. 6B and FIG. 6C with the maximum print ratio of ½ is used in a gradation range from low to intermediate level where small ink droplets of 5 pl are used. As described above, small ink droplets are easily affected by an air flow (see FIG. 13 and FIG. 14). As the print ratio increases, the end nozzle droplet deflection phenomenon becomes more likely to occur. For this reason, in the gradation range from low to intermediate level where small ink droplets are used, the lines of image defect occurred in the comparison example 2 because of the end nozzle droplet deflection phenomenon. In the case of the comparison example 1, on the other hand, the thinning patterns of FIG. 5A, FIG. 5B and FIG. 5C, whose print ratio for the small ink droplets is up to ⅓, are used. So, no lines of image defect occurred.

In a gradation range from intermediate to high level, large ink droplets of 10 pl are used in addition to the small ink droplets of 5 pl. In this gradation range this embodiment uses the thinning patterns of FIGS. 6A, 6B, 6C whose print ratio for large ink droplets of 10 pl is up to ½. Although the maximum print ratio is high at ½, since the ink droplets are large, they are not likely to result in the end nozzle droplet deflection phenomenon, and the cause for lines of image defect. Further, since high gradation areas of a printed image are fully filled with ink droplets, lines of image defects, if any, will not show.

It is found from the evaluation result of FIG. 9 that neither of this embodiment nor the comparison example 2 has produced density variations. The comparison example 1, however, has produced many density variations in a gradation range whose quantization level is close to 2, i.e., where the image duty for large ink droplets is close to 100%. In the gradation range from intermediate to high level, large ink droplets of 10 pl are used in addition to small ink droplets of 5 pl.

The comparison example 1 uses the thinning patterns of FIGS. 5A, 5B, 5C also for large ink droplets of 10 pl. As described above, if a difference should occur between ink droplet landing areas of the forward scan and the backward scan, density variations are likely to occur (see FIG. 15B and FIG. 15C). That is, if a large difference in ink droplet landing area occurs between the first region where the ratio of dots printed by the forward scans is higher and the second region where the ratio of dots printed by the backward scans is higher, the density variations are likely to occur. In the comparison example 1, the thinning patterns of FIGS. 5A, 5B, 5C are used that thin by ⅓ the dot density (print duty) for large ink droplets of 10 pl that tend to increase the ink droplet landing area difference. Thus, during the three printing scans that complete the image printing in the print regions A and C of FIG. 7, a total print ratio by all forward scans (also referred to as a "print ratio by all forward scans") is ⅔ (=⅓+⅓). A total print ratio by all backward scans (also referred to as a "print ratio by all backward scans") is ⅓. Therefore, there is a difference of ⅓ between these print ratios. Also in the print regions B and D of FIG. 7, there is a difference of ⅓ between the print ratio by all forward scans of ⅓ and the print ratio by all backward scans of ⅔ (=⅓+⅓). In other words, the print regions A and C are first regions with a ratio of dots printed by forward scans higher by ⅓, while the print regions B and D are second regions with a ratio of dots printed by backward scans higher by ⅓. In the case of the comparison example 1, since the first region and the second region appear alternately, density variations occurred.

In the case of this embodiment, the use of the thinning patterns of FIGS. 6A, 6B, 6C for large ink droplets has resulted in a difference between the print ratio by all forward scans and the print ratio by all backward scans becoming 0. That is, in the print regions A and C of FIG. 7, the difference between the print ratio of all forward scans of ½ (=¼+¼) and the print ratio of all backward scans of ½ is 0. Also in the print regions B and D of FIG. 7, the difference between the print ratio of all forward scans of ½ and the print ratio of all backward scans of ½ (=¼+¼) is 0. As described above, all these print regions A, B, C, D have the print ratio difference between all forward scans and all backward scans of 0, thus causing no density variations.

As for the small ink droplets, since the thinning patterns of FIGS. 5A, 5B, 5C are used, the difference between the print ratio of all forward scans and the print ratio of all backward scans is ⅓. This means that there occurs a difference in ink droplet landing area between the first region and the second region. However, such a landing area difference is small when the small ink droplet is used. So, density variations hardly occur.

As described above, for the small ink droplets, this embodiment uses thinning patterns that equally thin the print ratios (⅓ each), such as shown in FIGS. 5A, 5B, 5C. For the large ink droplets, on the other hand, the patterns of FIGS. 6A, 6B, 6C are used that makes the print ratio difference between all forward scans and all backward scans zero. As to the difference in print ratio between all forward scans and all backward scans, it is greater when the thinning patterns of FIGS. 5A, 5B, 5C are used than when the thinning patterns of FIGS. 6A, 6B, 6C are used, as described earlier.

In a printing operation performing an odd number of printing scans, the number of printing scans is greater in one of forward and backward directions than in the other direction. In the case of this embodiment, the thinning patterns of FIGS. 6A, 6B, 6C (first thinning patterns for large ink droplets) thin print data so that a print ratio of one printing scan in one direction (½) is higher than that in the other direction (¼). Further, in this embodiment, the thinning patterns of FIGS. 5A, 5B, 5C (first thinning patterns for small ink droplets) thin print data so that print ratios of one printing scan in the forward direction and in the backward direction are equal.

As a result, this embodiment can suppress both the image degradations caused by lines of image defect, which results from the end nozzle droplet deflection phenomenon, and the image degradations caused by density variations, which result from a print ratio difference between all forward scans and all backward scans, thus assuring a high-speed printing of high-quality images.

(Second Print Mode)

FIGS. 10A to 10D show thinning patterns to thin print data in a print mode that completes a printing operation in a predetermined print area (second predetermined area) by an even number of bidirectional printing scans (referred to as a "second print mode"). The second print mode of this example completes the printing in a predetermined area by four bidirectional printing scans. FIGS. 10A, 10B, 10C and 10D show thinning patterns to thin print data in a first, second, third, and fourth scan, respectively. These thinning patterns thin print data of 100% dot density (print duty) so that the dot density will be ¼ in each scan. That is, these thinning patterns are complementary to one another. In this example, the thinning patterns of FIG. 10A to FIG. 10D are thinning patterns for small ink droplets (also referred to as "second thinning patterns for small ink droplets" or "third thinning patterns") and, at the same time, thinning patterns for large ink droplets (also referred to as "second thinning pattern for large ink droplets" or "fourth thinning pattern").

Figure 11:
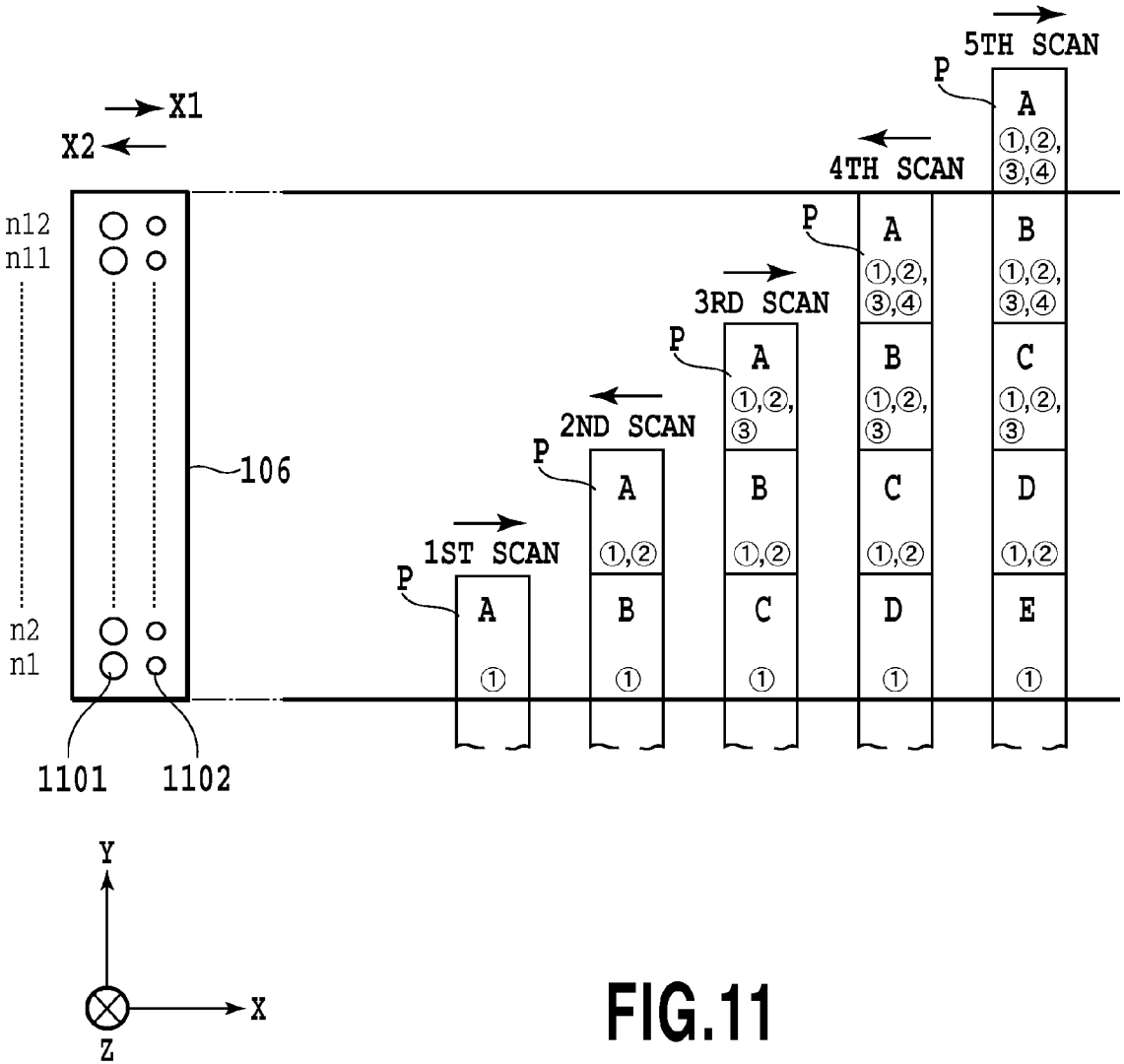
FIG. 11 is an explanatory diagram showing a second print mode-based printing method in the first embodiment of this invention.

FIG. 11 explains a printing operation in the second print mode of this example.

First, the print medium P is fed in the sub-scan direction (Y direction) to allow three large ink ejection openings 1101 of nozzle number n1 to n3 upstream with respect to the paper feed direction and three small ink ejection openings 1102 of the same nozzle number n1 to n3 to print on the print medium P. After the print medium P has been fed, a print region A of the print medium P is printed in the first scan in a forward direction (X1 direction) using the n1-n3 large ink ejection openings 1101 and n1-n3 small ink ejection openings 1102. At this time, the n1-n3 small ink ejection openings 1102 and the n1-n3 large ink ejection openings 1101 eject ink droplets of 5 pl and 10 pl, respectively, based on the print data thinned by the thinning pattern of FIG. 10A.

Then, the print medium P is fed in the sub-scan direction (Y direction) so that six large ink ejection openings 1101 of nozzle number n1-n6 and six small ink ejection openings 1102 of the same nozzle number n1-n6 can print on the print medium P. The feed distance corresponds to three dots of a 600-dpi resolution. After the feed operation is completed, a second scan in the backward direction (X2 direction) prints on print regions A, B of the print medium P.

The print region A is printed using n4-n6 small ink ejection openings 1102 and n4-n6 large ink ejection openings 1101. At this time, the n4-n6 small ink ejection openings 1102 and the n4-n6 large ink ejection openings 1101 eject ink droplets of 5 pl and 10 pl, respectively, based on the print data thinned by the thinning pattern of FIG. 10B.

The print region B is printed using n1-n3 small ink ejection openings 1102 and n1-n3 large ink ejection openings 1101. At this time, the n1-n3 small ink ejection openings 1102 and the n1-n3 large ink ejection openings 1101 eject ink droplets of 5 pl and 10 pl, respectively, based on the print data thinned by the thinning pattern of FIG. 10A. Thus, for the print region B, this scan is the first one.

Then, the print medium P is fed in the sub-scan direction (Y direction) so that nine large ink ejection openings 1101 of nozzle number n1-n9 and nine small ink ejection openings 1102 of the same nozzle number n1-n9 can print on the print medium. The feed distance corresponds to three dots of a 600-dpi resolution. After the feed operation is completed, a third scan in the forward direction (X1 direction) prints on print regions A, B, C of the print medium P.

The print region A is printed using n7-n9 small ink ejection openings 1102 and n7-n9 large ink ejection openings 1101. At this time, the n7-n9 small ink ejection openings 1102 and the n7-n9 large ink ejection openings 1101 eject ink droplets of 5 pl and 10 pl, respectively, based on the print data thinned by the thinning pattern of FIG. 10C.

The print region B is printed using n4-n6 small ink ejection openings 1102 and n4-n6 large ink ejection openings 1101. At this time, the n4-n6 small ink ejection openings 1102 and the n4-n6 large ink ejection openings 1101 eject ink droplets of 5 pl and 10 pl, respectively, based on the print data thinned by the thinning pattern of FIG. 10B. Thus, for the print region B, this scan is the second one.

The print region C is printed using n1-n3 small ink ejection openings 1102 and n1-n3 large ink ejection openings 1101. At this time, the n1-n3 small ink ejection openings 1102 and the n1-n3 large ink ejection openings 1101 eject ink droplets of 5 pl and 10 pl, respectively, based on the print data thinned by the thinning pattern of FIG. 10A. Thus, for the print region C, this scan is the first one.

Then, the print medium P is fed in the sub scan direction (Y direction) so that large ink ejection openings 1101 of nozzle number n1-n12 and small ink ejection openings 1102 of the same nozzle number n1-n12 can print on the print medium P. The feed distance corresponds to three dots of a 600-dpi resolution. After the feed operation is completed, a fourth scan in the backward direction (X2 direction) prints on print regions A, B, C, D of the print medium P.

The print region A is printed using n10-n12 small ink ejection openings 1102 and n10-n12 large ink ejection openings 1101. At this time, the n10-n12 small ink ejection openings 1102 and the n10-n12 large ink ejection openings 1101 eject ink droplets of 5 pl and 10 pl, respectively, based on the print data thinned by the thinning pattern of FIG. 10D.

The print region B is printed using n7-n9 small ink ejection openings 1102 and n7-n9 large ink ejection openings 1101. At this time, the n7-n9 small ink ejection openings 1102 and the n7-n9 large ink ejection openings 1101 eject ink droplets of 5 pl and 10 pl, respectively, based on the print data thinned by the thinning pattern of FIG. 10C. Thus, for the print region B, this scan is the third one.

The print region C is printed using n4-n6 small ink ejection openings 1102 and n4-n6 large ink ejection openings 1101. At this time, the n4-n6 small ink ejection openings 1102 and the n4-n6 large ink ejection openings 1101 eject ink droplets of 5 pl and 10 pl, respectively, based on the print data thinned by the thinning pattern of FIG. 10B. Thus, for the print region C, this scan is the second one.

The print region D is printed using n1-n3 small ink ejection openings 1102 and n1-n3 large ink ejection openings 1101. At this time, the n1-n3 small ink ejection openings 1102 and the n1-n3 large ink ejection openings 1101 eject ink droplets of 5 pl and 10 pl, respectively, based on the print data thinned by the thinning pattern of FIG. 10A. Thus, for the print region D, this scan is the first one.

Then, the print medium P feed operation and the printing scan are alternately repeated in the similar way to successively form bands of image until a complete image is formed on a print medium P.

As described above, to thin print data for both large ink ejection openings 1101 and small ink ejection openings 1102, this second print mode uses thinning patterns that equally thin the dot density (print duty) in each scan. In this example of the second print mode that completes the image printing in a predetermined print area by an even number, in this case four, of bidirectional printing scans, thinning patterns of FIG. 10A to FIG. 10D are used that thin the dot density by ¼ in each scan.

By using such thinning patterns for large ink droplets to make the print ratios in all printing scans equal at ¼, lines of image defects caused by the end nozzle droplet deflection phenomenon can be minimized. Further, making a print ratio difference between all forward scans and all backward scans zero can prevent a possible occurrence of density variations caused by the print ratio difference.

As to the small ink droplets, it is likewise possible to minimize lines of image defects caused by the end nozzle droplet deflection phenomenon by using such thinning patterns for small ink droplets to make the print ratios in all printing scans equal at ¼. Furthermore, by making a print ratio difference between all forward scans and all backward scans zero, a possible occurrence of density variations caused by the print ratio difference can be forestalled.

In this example, the thinning patterns of FIG. 10A to FIG. 10D double as the second thinning patterns for small ink droplets and the second thinning patterns for large ink droplets. These thinning patterns thin print data in such a manner that makes the print ratio in each printing scan in the forward direction and the print ratio in each printing scan in the backward direction equal at ¼.

As described above, this embodiment uses a first print mode for a printing operation that completes an image in a predetermined area by an odd number of bidirectional printing scans. It also uses a second print mode for a printing operation that completes an image in a predetermined area by an even number of bidirectional printing scans. In each of the above two printing operations, this method can suppress both two types of image degradations, one caused by lines of image defect resulting from the end nozzle droplet deflection phenomenon and one caused by density variations resulting from a print ratio difference between all forward scans and all backward scans, allowing for a high-speed printing of high-quality images.

Second Embodiment

In the first embodiment, cyan ink ejection openings include large ink ejection openings and small ink ejection openings. Like the cyan ink ejection openings, a magenta ink ejection openings of this embodiment also include large ink ejection openings and small ink ejection openings. A print head of this embodiment has equal ink droplet landing areas in both the forward scans and the backward scans. So, there is no print ratio difference between all forward scans and all backward scans, as is observed in FIG. 15B and FIG. 15C.

In this embodiment, a relation between a quantization level (grayscale level) of image data and dot patterns of cyan and magenta inks is the same as that shown in FIG. 4 of the preceding embodiment.

(First Print Mode)

A first print mode of this embodiment uses thinning patterns of FIGS. 5A, 5B, 5C and FIGS. 6A, 6B, 6C, as in the first embodiment, for cyan ink and magenta ink print data. That is, print data to form small dots S of cyan and magenta inks is thinned using the thinning patterns of FIGS. 5A, 5B, 5C. Print data to form large dots L of these inks is thinned using the thinning patterns of FIGS. 6A, 6B, 6C. Then, as in the first embodiment, three bidirectional printing scans are performed, as shown in FIG. 7, to complete the printing in a predetermined area.

FIG. 12 shows results of evaluations about how serious a color variation problem is for each grayscale level of a blue color printed by overlapping a cyan ink and a magenta ink. A subjective evaluation was made on a degree of image quality degradations caused by color variations in the first print mode of this embodiment and comparison examples 1, 2 described later. In the table of evaluation result, a mark × represents "bad" as a subjective evaluation of image quality, Δ represents "slightly bad" and ○ represents "no problem". The results of these evaluations show that this embodiment has no problem, as in the first embodiment.

In the comparison example 1, print data to eject ink droplets of 5 pl and 10 pl to form small dots S and large dots L of cyan and magenta inks is thinned using thinning patterns of FIGS. 5A, 5B, 5C. In the comparison example 2, thinning patterns of FIGS. 6A, 6B, 6C are used to thin print data for ejecting ink droplets of 5 pl and 10 pl to form small dots S and large dots L of cyan and magenta inks.

The evaluation result in FIG. 12 shows that no color variations have occurred at any grayscale level in this embodiment nor the comparison example 2. In the comparison example 1, however, color variations have occurred at grayscale levels close to a quantization level of 2, where a print duty of large 10-pl droplets is close to 100%, degrading image quality.

In the forward scans, a magenta ink is ejected following a cyan ink, while in the backward scans the magenta ink ejection precedes the cyan ink ejection. This difference in the cyan and magenta ink ejection order can cause a large difference in color between the forward scan and the backward scan particularly when the ink droplet volume is large. When the thinning patterns of FIGS. 5A, 5B, 5C are used, a print ratio difference between all forward scans and all backward scans is ⅓. The comparison example 1 uses the thinning patterns of FIGS. 5A, 5B, 5C also for the large 10-pl ink droplets. Thus, in the comparison example 1, color variations occurred degrading image quality in a grayscale range from intermediate to high level where large 10-pl ink droplets are used in addition to small 5-pl inks droplets.

As in the first embodiment, this embodiment also uses, during the first print mode, the thinning patterns of FIGS. 6A, 6B, 6C for large ink droplets that make a print ratio difference between all forward scans and all backward scans zero. For small ink droplets, on the other hand, the thinning patterns of FIGS. 5A, 5B, 5C are used that make print ratios in individual printing scans equal (⅓ each). As a result, both two types of image degradations, one caused by lines of image defect resulting from the end nozzle droplet deflection phenomenon and one caused by density variations resulting from a print ratio difference between all forward scans and all backward scans, can be minimized, allowing for a high-speed printing of high-quality images.

(Second Print Mode)

A printing operation according to the second print mode of this embodiment uses thinning patterns of FIGS. 10A to 10D for each of print data of cyan ink and magenta ink, as in the first embodiment. Then, like the first embodiment, the second embodiment also completes the printing operation in a predetermined area with four bidirectional printing scans, as shown in FIG. 11. By using such thinning patterns for large ink droplets and making the print ratios for all printing scans equal at ¼, it is possible to suppress lines of image defects resulting from the end nozzle droplets deflection phenomenon.

As described above, in a printing method that completes an image with an odd or even number of bidirectional printing scans, this embodiment uses the first and second print mode that are also used in the first embodiment. This method can suppress both two types of image degradations, one caused by lines of image defect resulting from the end nozzle droplet deflection phenomenon and one caused by density variations resulting from a print ratio difference between all forward scans and all backward scans, allowing for a high-speed printing of high-quality images.

(Other Embodiments)

In the first print mode of the preceding embodiments, the thinning patterns for large ink droplets thin print data so that the print ratios of individual scans will be ¼, ½ and ¼, as shown in FIGS. 6A, 6B 6C. The thinning patterns for large ink droplet print data, however, are not limited to this example. They may be configured in a way that will set the print ratios to 3/10, 4/10 and 3/10. In the first print mode of the preceding embodiments, the thinning patterns for small ink droplets thin print data so that the print ratios of individual scans will be ⅓, ⅓ and ⅓, as shown in FIGS. 5A, 5B, 5C. The thinning patterns for small ink droplet print data, however, are not limited to this example. They may be configured in a way that will set the print ratios to 3/10, 4/10 and 3/10. In other words, a print ratio difference between total forward scans and total backward scans that is produced by the thinning patterns for large ink droplet print data needs only to be smaller than a print ratio difference between total forward scans and total backward scans that is produced by the thinning patterns for small ink droplet print data. Satisfying such a relation between the two print ratio differences can produce the same effect as the preceding embodiments.

The thinning patterns are not limited to fixed patterns, such as used in the preceding embodiments. They may be increased in size to be random thinning patterns that are complementary to one another.

A grayscale representation method is not limited to one using a relation between a quantization level and a dot pattern as shown in FIG. 4. For example, the grayscale may be represented by using ink droplets of three different volumes—large, medium and small. In that case, of three combinations of two different ink volumes—large and medium ink droplets, large and small ink droplets and medium and small ink droplets—at least one combination needs to have a print ratio relation set as described in the preceding embodiments to suppress image degradations caused by lines of image defects and by density variations. Further, for the second and third combination, it is preferred that the print ratio relation be also set in the similar way. As the number of combinations that set the relation of such print ratios increases, the effect of minimizing the image degradations caused by lines of image defects and by density variations also increases. By representing a grayscale level using ink droplets of at least two different volumes, the similar effects to those of the preceding embodiments can be obtained.

In the preceding embodiments, cyan and magenta inks are used. But other color inks, such as yellow and black, may also be used. It is also possible to use inks of the same color but with different concentrations and still produce the similar effects.

Further, in the second embodiment two color inks are used. It is also possible to use three or more color inks and produce the similar effects.

The present invention is not limited to cases where the grayscale representation need be the same for different ink colors. For example, one ink color may be represented by ink droplets of two different volumes—large and small; another ink color may be represented by ink droplets of only one volume—large droplets; still another ink color may be represented by ink droplets of three different volumes—large, medium and small; yet another ink color may be represented by ink droplets of two different volumes—large and medium. Even if the grayscale representation method differs among different ink colors, the similar effects to those of the preceding embodiments can still be obtained. For example, for cyan and magenta inks whose brightness is low and dot graininess easily shows, a grayscale representation using two different dots—small and large dots—in FIG. 4 of the preceding embodiment may be used. For a yellow ink whose dot graininess easily shows and its brightness is high, a grayscale representation using only one kind of dots—large dots—may be used. At this time, thinning patterns for large yellow dots may be the same as those used for large cyan or magenta dots to produce the similar effects to those of the preceding embodiments. In other words, the similar effects to those of the preceding embodiments can be obtained as long as the relation between large yellow dots and small cyan or magenta dots satisfies the relation between the large dots and small dots described in the preceding embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-239324, filed Sep. 14, 2007, which is hereby incorporated by reference herein in its entirety.

What is claimed is:

1. An ink jet printing apparatus comprising:

a print head including a first ejection opening array arranged in a predetermined direction and formed by first ejection openings for ejecting first ink droplets and a second ejection opening array arranged in the predetermined direction and formed by second ejection openings for ejecting second ink droplets which have a smaller volume than a volume of the first ink droplets;

a control unit that causes the print head to scan over a predetermined area of a print medium in a forward direction and a backward direction, crossing the predetermined direction, an odd number of times in total to form an image on the predetermined area, a length of the predetermined area of the print medium being equal to or less than a length of at least one of the first and second ejection opening arrays in the predetermined direction; and a defining unit that defines ratios for ejecting the first ink droplets in each of the scans of the print head and ratios for ejecting the second ink droplets in each of the scans of the print head, wherein the defining unit defines the ratios for ejecting the first ink droplets so that the ratio in one of the even-numbered scans is higher than that in one of the odd-numbered scans, and wherein a first difference between a total of the ratios of all the even-numbered scans and a total of the ratios of all the odd-numbered scans for the first ink droplets is smaller than a second difference between a total of the ratios of all the even-numbered scans and a total of the ratio of all the odd-numbered scans for the second ink droplets.

2. The ink jet printing apparatus according to claim 1, wherein the defining unit uses a thinning pattern for the second ink droplets that makes equal the ratio for an even-numbered scan and the ratio for an odd-numbered scan.

3. The ink jet printing apparatus according to claim 1, wherein the print head can eject large and small ink droplets of different volumes for each of at least two different inks.

4. The ink jet printing apparatus according to claim 1, wherein the control unit can print an image by causing the print head to scan over a second predetermined area of the print medium in the forward direction and the backward direction an even number of times in total; and wherein the defining unit defines the ratios for ejecting the first and the second ink droplets in the second predefined area so that, for each of the first and second ejection opening arrays, a difference between a total of the ratio of all the forward scans of the even number of scans and a total of the ratio of all the backward scans of the even number of scans are equal.

5. An ink jet printing method for printing on a print medium using a print head including a first ejection opening array arranged in a predetermined direction and formed by first ejection openings for ejecting first ink droplets and a second ejection opening array arranged in the predetermined direction and formed by second ejection openings for ejecting second ink droplets which have a smaller volume than a volume of the first ink droplets, the method comprising the steps of:

causing the print head to scan over a predetermined area of a print medium in a forward direction and a backward direction, crossing the predetermined direction, an odd number of times in total to form an image on the predetermined area, a length of the predetermined area of the print medium being equal to or less than a length of at least one of the first and second ejection opening arrays in the predetermined direction; and defining ratios for ejecting the first ink droplets in each of the scans of the print head and ratios for ejecting the second ink droplets in each of the scans of the print head, wherein the ratios for ejecting the first ink droplets are defined so that the ratio in one of the even-numbered scans is higher than that in one of the odd-numbered scans, and wherein a first difference between a total of the ratios of all the even-numbered scans and a total of the ratios of all the odd-numbered scans for the first ink droplets is smaller than a second difference between a total of the ratios of all the even-numbered scans and a total of the ratio of all the odd-numbered scans for the second ink droplets.

6. The ink jet printing method according to claim 5, wherein the defining step uses a thinning pattern for the second ink droplets that makes equal the ratio for an even-numbered scan and the ratio for an odd-numbered scan.

7. The ink jet printing method according to claim 5, wherein the print head can eject large and small ink droplets of different volumes for each of at least two different inks.

8. The ink jet printing method according to claim 5, wherein an image can be printed by causing the print head to scan over a second predetermined area of the print medium in the forward direction and the backward direction an even number of times in total, and wherein the ratios for ejecting the first and the second ink droplets in the second predetermined area so that, for each of the first and second ejection opening arrays, a difference between a total of the ratio of all the forward scans of the even number of scans and a total of the ratio of all the backward scans of the even number of scans are equal.

9. A print control apparatus for controlling an ink jet printing apparatus using a print head, the print head including a first ejection opening array arranged in a predetermined direction and formed by first ejection openings for ejecting first ink droplets and a second ejection opening array arranged in the predetermined direction and formed by second ejection openings for ejecting second ink droplets which have a smaller volume than a volume of the first ink droplets, the print control apparatus comprising:

a control unit that causes the print head to scan over a predetermined area of a print medium in a forward direction and a backward direction, crossing the predetermined direction, an odd number of times in total to form an image on the predetermined area, a length of the predetermined area of the print medium being equal to or less than a length of at least one of the first and second ejection opening arrays in the predetermined direction;

a defining unit that defines ratios for ejecting the first ink droplets in each of the scans of the print head and ratios for ejecting the second ink droplets in each of the scans of the print head, wherein the defining unit defines the ratios for ejecting the first ink droplets so that the ratio in one of the even-numbered scans is higher than that in one of the odd-numbered scans, and wherein a first difference between a total of the ratios of all the even-numbered scans and a total of the ratios of all the odd-numbered scans for the first ink droplets is smaller than a second difference between a total of the ratios of all the even-numbered scans and a total of the ratio of all the odd-numbered scans for the second ink droplets.

10. The print control apparatus according to claim 9, wherein the defining unit uses a thinning pattern for the second ink droplets that makes equal the ratio for an even-numbered scan and the ratio for an odd-numbered scan.

11. The print control apparatus according to claim 9, wherein the print head can eject large and small ink droplets of different volumes for each of at least two different inks.

12. The print control apparatus according to claim 9, wherein the control unit can print an image by causing the print head to scan over a second predetermined area of the print medium in the forward direction and the backward direction an even number of times in total, and wherein the defining unit defines the ratios for ejecting the first and the second ink droplets in the second predetermined area so that, for each of the first and second ejection opening arrays, a difference between a total of the ratio of all the forward scans of the even number of scans and a total of the ratio of all the backward scans of the even number of scans are equal.

* * * * *